US005829715A

United States Patent [19]

Banks

[11] Patent Number: 5,829,715

[45] Date of Patent: Nov. 3, 1998

[54] MULTI-AXIS UNFOLDING MECHANISM WITH RATE CONTROLLED SYNCHRONIZED MOVEMENT

[75] Inventor: John Edward Banks, Arlington, Tex.

[73] Assignee: Lockheed Martin Vought Systems Corp., Grand Prairie, Tex.

[21] Appl. No.: 748,149

[22] Filed: Nov. 12, 1996

Related U.S. Application Data

[63] Continuation-in-part of Ser. No. 634,931, Apr. 19, 1996, abandoned.

[51] Int. Cl.[6] ..... B64C 3/56

[52] U.S. Cl. ..... 244/49; 244/3.27

[58] Field of Search ..... 244/49, 129.1, 244/120, 124, 3.27–3.29

[56] References Cited

U.S. PATENT DOCUMENTS

| | | | |
|---|---|---|---|
| 3,029,043 | 4/1962 | Churchill | 244/7 |
| 4,323,208 | 4/1982 | Ball | 244/3.29 |
| 4,884,766 | 12/1989 | Steinmetz et al. | 244/3.27 |
| 5,192,037 | 3/1993 | Moorefield | 244/46 |
| 5,326,049 | 7/1994 | Rom et al. | 244/3.28 |

FOREIGN PATENT DOCUMENTS

| | | |
|---|---|---|
| 0 013 096 | 7/1980 | European Pat. Off. . |
| 1 597 098 | 9/1981 | United Kingdom . |
| 2 140 136 | 11/1984 | United Kingdom . |

*Primary Examiner*—Galen L. Barefoot
*Attorney, Agent, or Firm*—Sidley & Austin

[57] ABSTRACT

A mechanism (100) is disclosed for deploying wing air foils about mutually perpendicular axes. Air flow initiates deployment of the wings by causing pivoting motion of a T-joint fitting (112). Meshed gear teeth between the wing (122) and the elevation plate (108) also causes the elevation plate to pivot. The axis of pivotal motion of the elevation plate (108) and the T-joint fitting (112) are offset so that the gear teeth on the elevation plate (108) causes the wing to move from the folded position to the elevated position. A pair of wings are deployed simultaneously by use of a cross shaft (134) that interconnects the elevation plates (108) of each wing deployment apparatus. A hydraulic damper (146) can be operated by the cross shaft (134) to allow control of the rate of deployment of the wings.

10 Claims, 13 Drawing Sheets

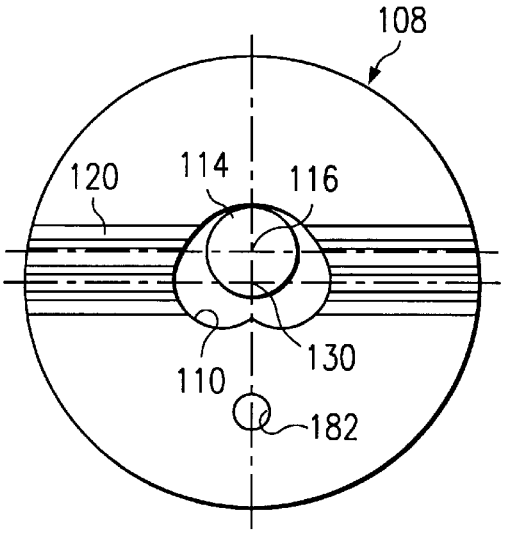
FIG. 14A
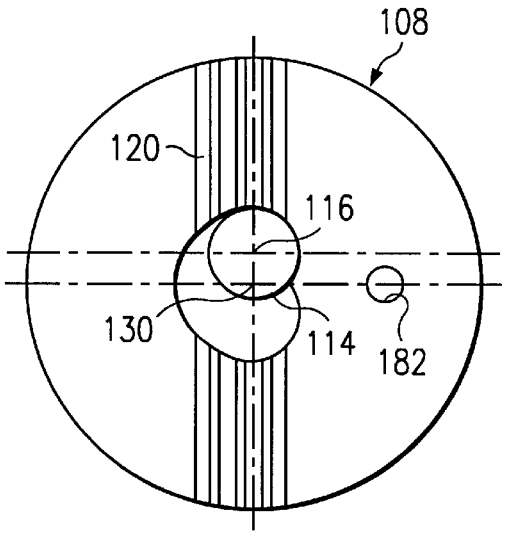
FIG. 14B
FIG. 15
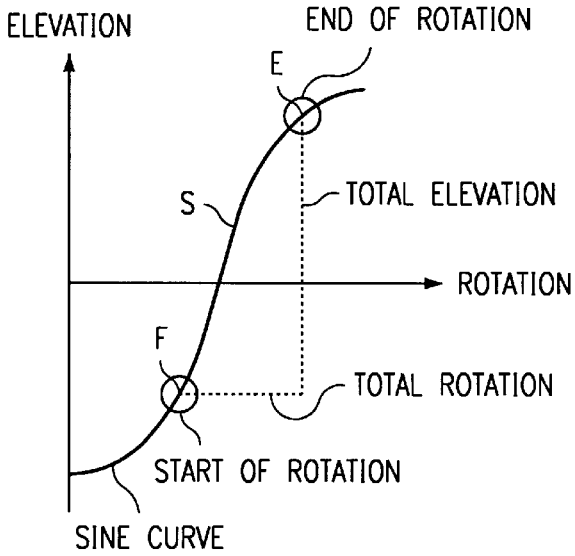
THE PORITION AND AMOUNT OF A SINE CURVE THAT DEFINES THE ELEVATION MOTION IS DETERMINED BY:
: THE ANGULAR AND RADIAL OFFSET OF THE T-JOINT AND ELEVATION PLATE AXES
:THE TOTAL AMOUNT OF ROTATION
:THE PITCH DIAMETER OF THE WING ROOT FITTING GEAR TEETH

MULTI-AXIS UNFOLDING MECHANISM WITH RATE CONTROLLED SYNCHRONIZED MOVEMENT

CROSS-REFERENCE TO RELATED APPLICATIONS

This application in a continuation-in-part of U.S. patent application Ser. No. 08/634,931 filed Apr. 19, 1996, now abandoned.

TECHNICAL FIELD OF THE INVENTION

This invention relates to an air foil deployment system for use on a missile, rocket or the like.

BACKGROUND OF THE INVENTION

To facilitate maximum load out of submunitions in delivery vehicles such as TACMs or MLRs, folding aerodynamic surfaces on the submunition are often required. Such a construction preferably has a minimum intrusive volume, a minimum of complexity and high reliability. A need exists for an effective design for the deployment of aerodynamic surfaces in such an environment.

SUMMARY OF THE INVENTION

In accordance with one aspect of the present invention, a mechanism is provided for deploying an air foil. The mechanism includes a frame and an elevation plate mounted on the frame for pivotal motion about a first axis. A T-joint is mounted to the frame for pivotal motion about a second axis. A wing assembly is mounted to the T-joint for pivotal motion about a third axis between a storage position and an elevated position. Pivotal motion of the T-joint about the second axis causes pivotal motion of the elevation plate about the first axis and of the wing assembly about the third axis.

In accordance with another aspect of the present invention, the wing assembly is formed by a wing mounted on a wing root. Further, the first and second axes are parallel and the third axis is perpendicular thereto. In accordance with another aspect of the present invention, the wing root has a series of gear teeth thereon and the elevation plate has a series of gear teeth thereon, the gear teeth on the wing root and elevation plate in meshing engagement.

In accordance with another aspect of the present invention, a second mechanism is provided, the elevation plate of each mechanism having a series of beveled gear teeth around the peripheries thereof. A cross shaft having beveled teeth engaging the beveled teeth on the elevation plates insure joint motion of the elevation plates. In accordance with another aspect of the present invention, a hydraulic damper is in operable engagement with the cross shaft to control the speed of motion of the elevation plates.

BRIEF DESCRIPTION OF THE DRAWINGS

For a more complete understanding of the present invention and for further advantages thereof, reference is now made to the following description of the preferred embodiment taken in conjunction with the accompanying drawings, in which:

FIGS. 14*a* and 14*b* illustrate the elevation plate in the unfolded position and the folded position;

FIG. 15 is a graphical representation of the elevation versus rotation of the mechanism;

DETAILED DESCRIPTION

Figure 1:
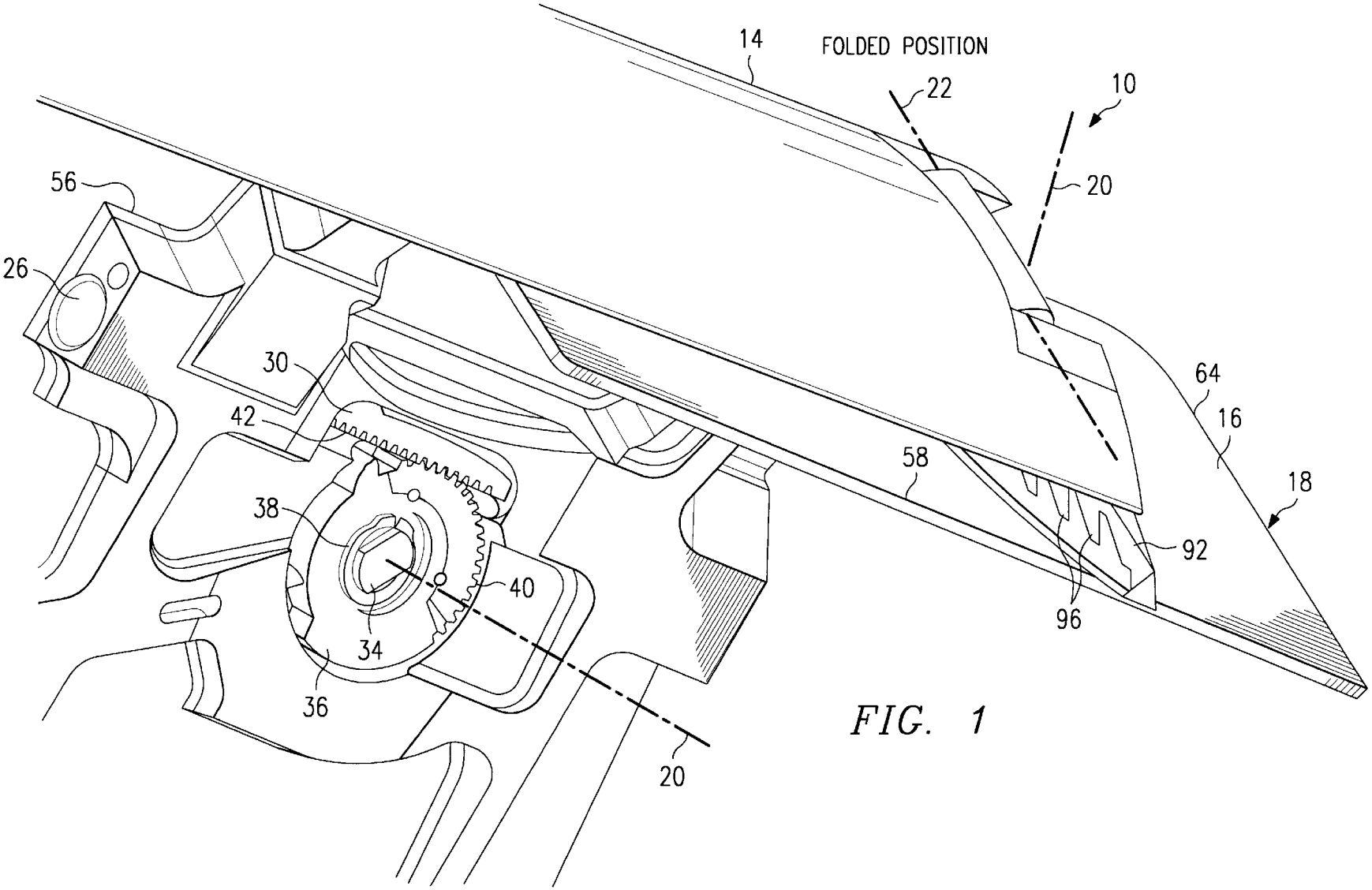
FIG. 1 is a perspective view of a mechanism forming a first embodiment of the present invention with the air foils in the folded position.
Figure 2:
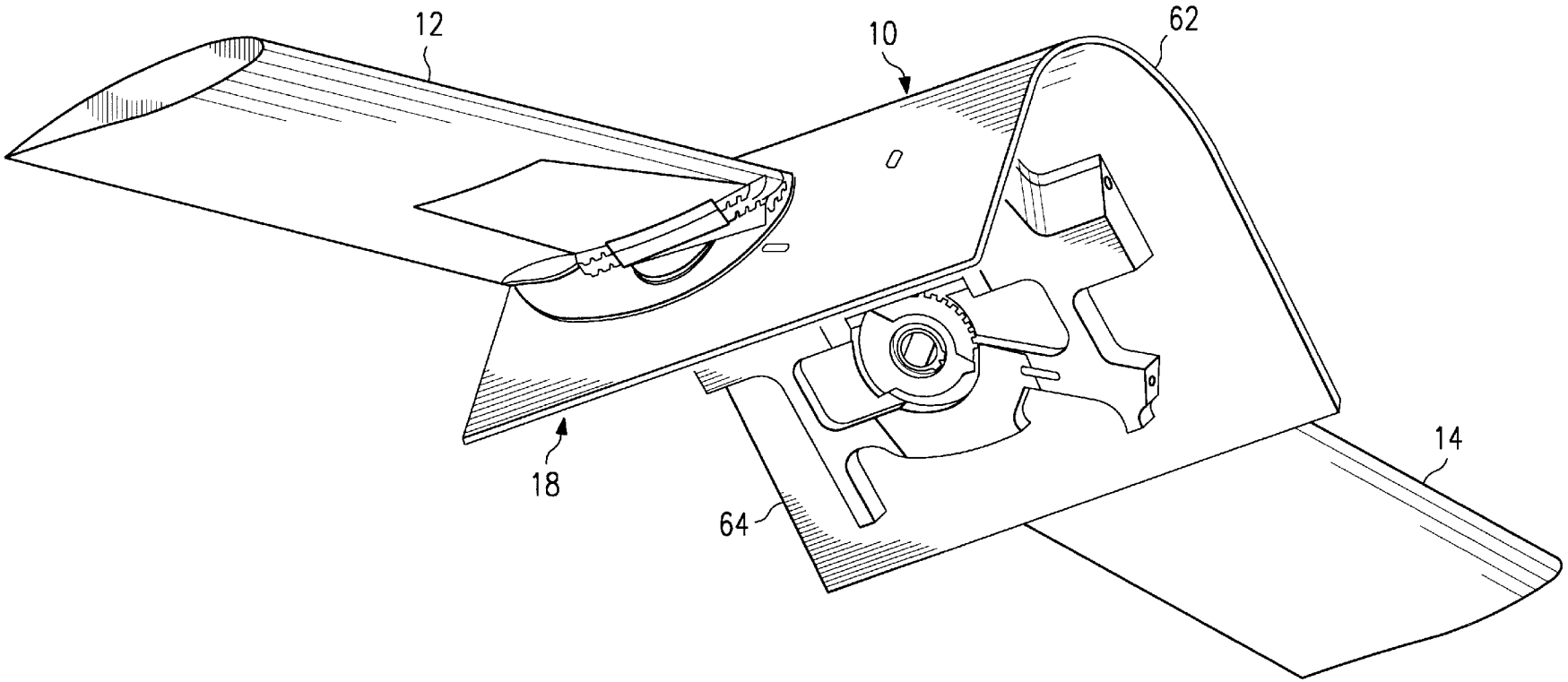
FIG. 2 is a perspective view of the mechanism showing the air foils in the deployed position.
Figure 3:
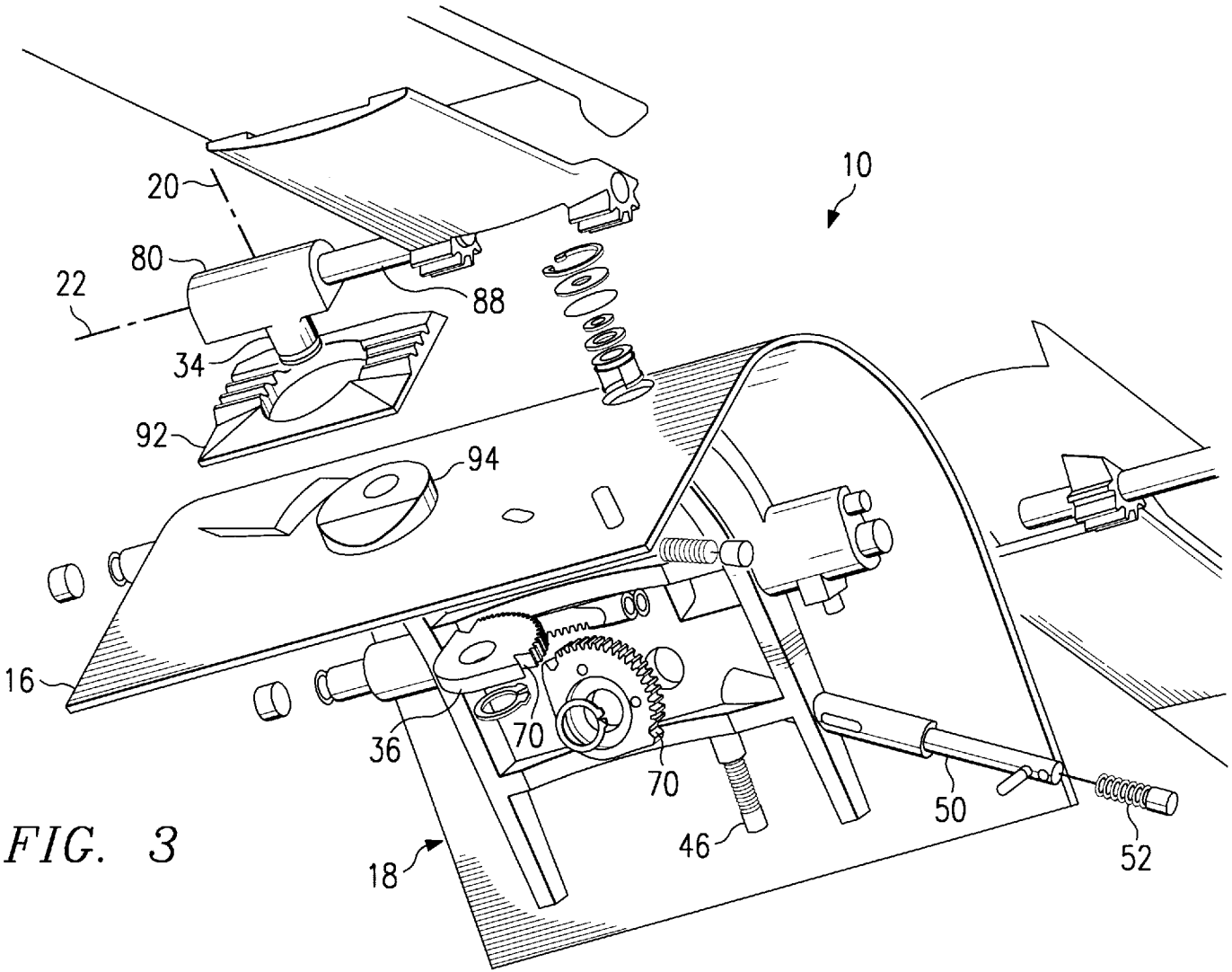
FIG. 3 is an exploded view of the mechanism.

With reference now to the figures, and in particular to FIGS. 1–3, a mechanism 10 is illustrated which is capable of deploying simultaneously a pair of air foils 12 and 14 on the exterior surface 16 of a bridge structure 18. The bridge structure can be a portion of the frame or body of a rocket or missile. More specifically, the mechanism can be applied to the LOCAAS/LORISK air frame, although the general principles of this mechanism could be tailored to suit many different applications.

As will be described in greater detail, the mechanism 10 allows pivotal motion of the air foils about rotation axes 20 while simultaneously pivoting the air foils about elevation axes 22 perpendicular to rotation axes 20 when moving between the folded configuration, seen in FIG. 1, and the deployed configuration, shown in FIG. 2, at an adjustably controlled rate.

Figure 5:
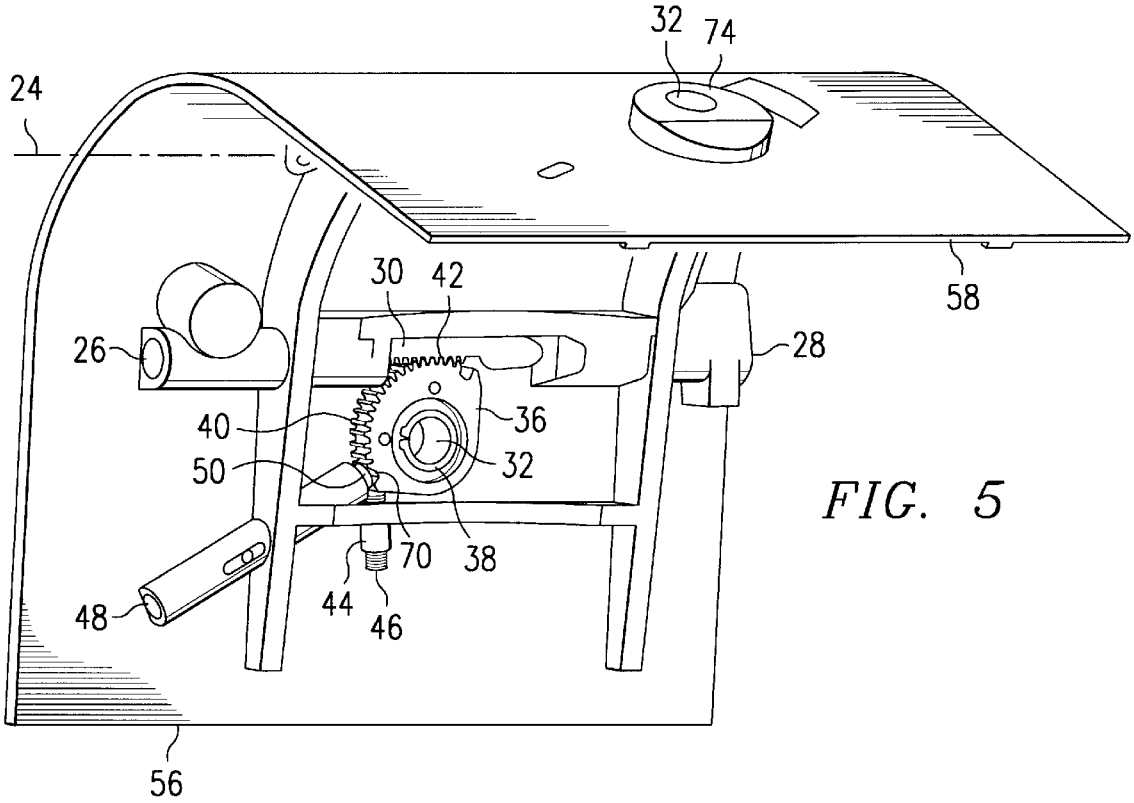
FIG. 5 is a perspective view of the bridge of the mechanism illustrating the rack shaft and rotation gear and cam surface on the bridge.
Figure 6:
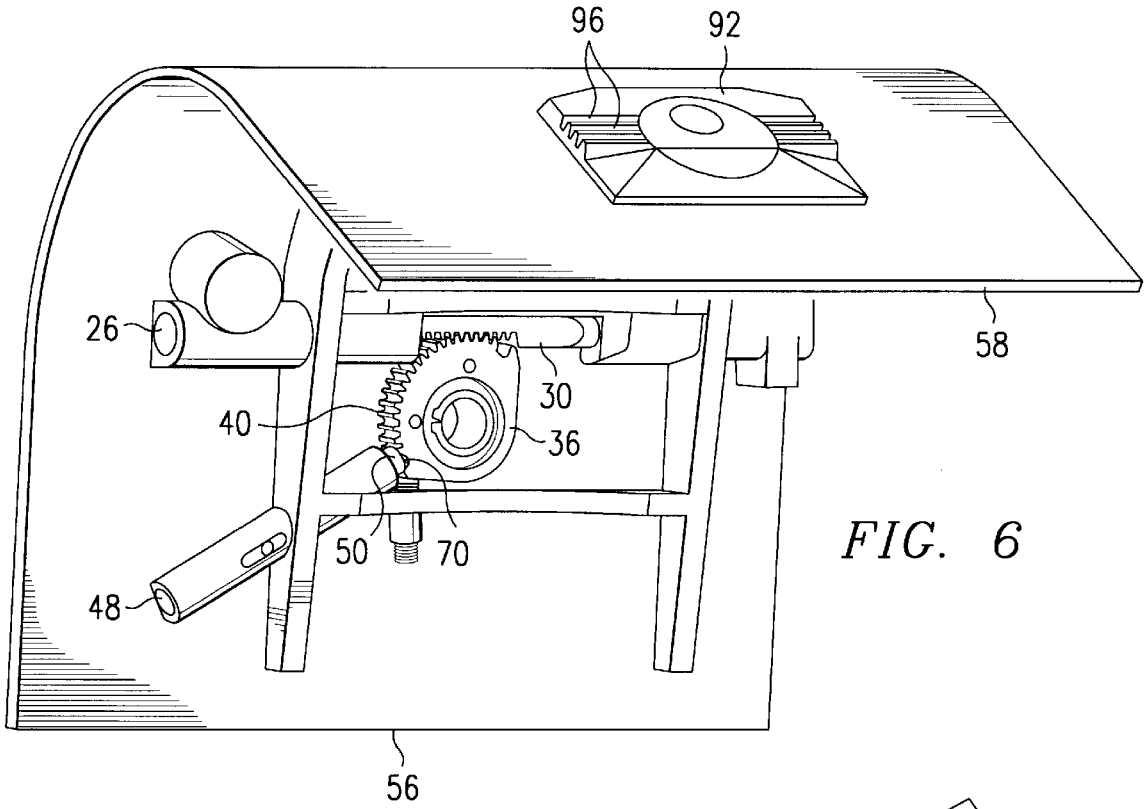
FIG. 6 is a perspective view of the bridge illustrating the sliding gear on the bridge.

With reference to FIG. 5, the bridge structure 18 can be seen to be formed in a symmetrical manner about its center line 24 to define first portion 56 and second portion 58. Each portion of the bridge structure includes a rack boss defining facing passages 26 and 28 for receiving the ends of a rack shaft 30. An aperture 32 through each portion of the bridge structure 18 receives a rotation axle 34 (best seen in FIG. 7). A rotation gear 36 is secured to the inner end of the rotation axle 34 for rotation therewith by a snap ring 38. The teeth 40 of the rotation gear 36 are meshed with teeth 42 of the rack shaft 30. Each portion of the bridge structure 18 also has a threaded boss 44 which receives a bump stop 46. Also, a lock boss defines a passage 48 which receives a rotation lock 50 that is urged toward the rotation gear 36 by a spring 52 (see FIG. 3) in passage 48 acting on the lock 50.

Figure 4:
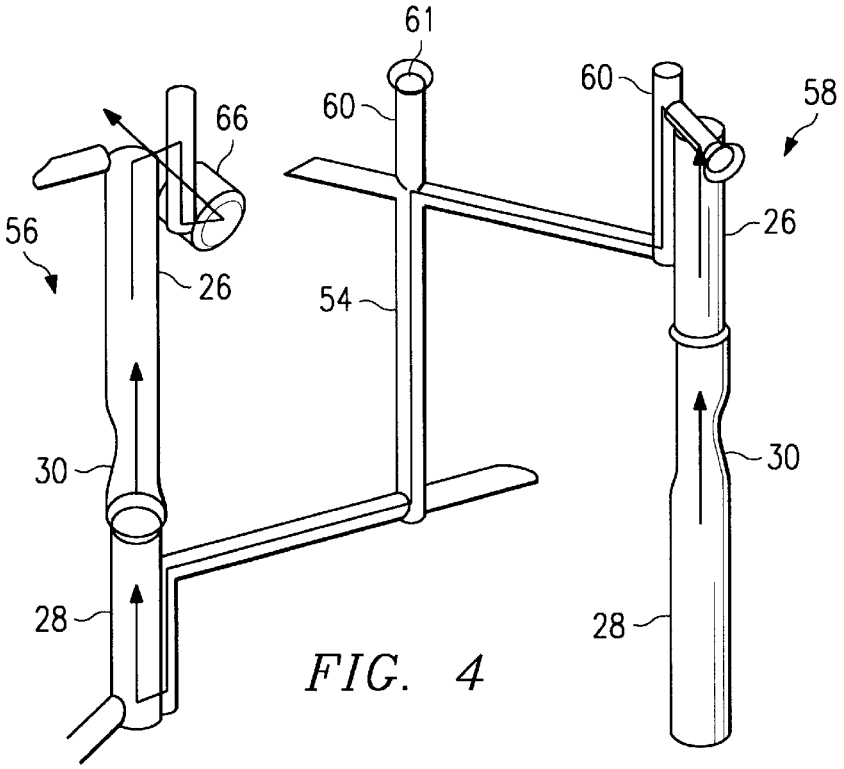
FIG. 4 is an illustrative view of the hydraulic circuit and rack shaft and rotation gear of the mechanism.

As best seen in FIG. 4, a passage 54 interconnects the passage 28 formed on the first portion 56 of the bridge structure 18 and passage 26 on the second portion 58 of the bridge structure 18. Hydraulic seals are provided at each end of the rack shafts 30 to seal against the surfaces of passages 26 and 28 to provide a hydraulic seal. The passage 26 on the first portion 56 connects to a pocket 66 which opens through the exterior surface 16 of the bridge structure 18. A hydraulic damper 68, which will be described in detail hereinafter, is mounted in the pocket 66 to control the movement of the rack shafts 30.

The passage 26 in second portion 58, passage 54 and passage 28 on first portion 56 are completely filled with a hydraulic fluid. The fluid can be entered into the passages through a hydraulic fill port 60. It is important to bleed all air and other gases out of the passages so that fluid completely occupies the volume in the passages. A hydraulic volume adjust screw 61 in the fill port 60 allows the volume in the passages to be varied slightly by screwing the adjustment screw in or out. This permits an adjustment of the angle of the air foils to insure that the air foils are not skewed when in the folded or open configurations. It is desired to have the air foils oriented in the open position within ¼° of angle relative each other.

Simultaneously, the passage 26 in the first portion 56 is completely filled with hydraulic fluid.

With the hydraulic fluid passages filled, any movement of one of the air foils is immediately transmitted through the hydraulic fluid to influence the other air foil. Further, movements of the air foils in the direction of deployment will pressurize the hydraulic fluid in the passage 26 in the first portion 56, exerting a force on the hydraulic damper 68, which causes a pressure diaphragm to burst and thereafter controlling the rate of discharge of the hydraulic fluid and thus controlling the rate of deployment of the air foils.

Figure 7:
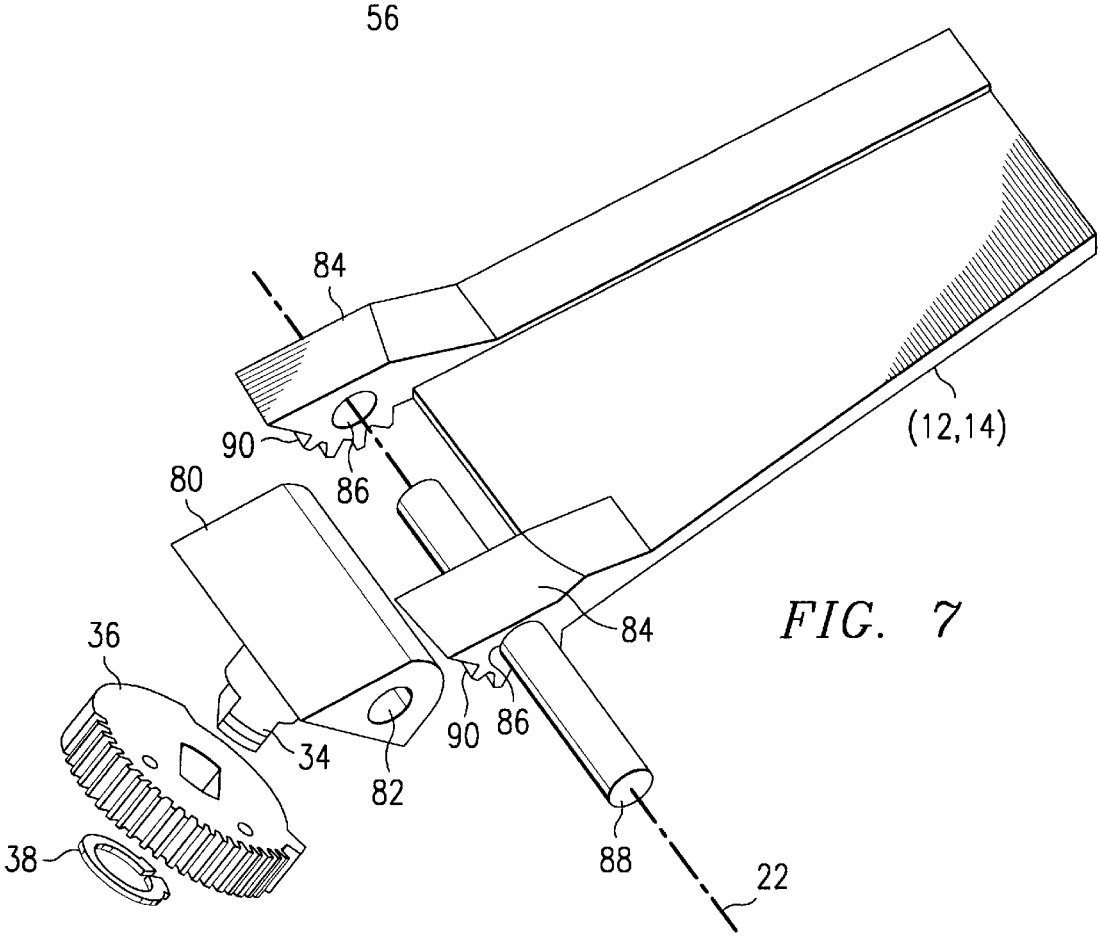
FIG. 7 is a perspective view of the air foil.

With reference now to FIGS. 1, 2 and 7, each rotation axle 34 can be seen to end in a cylinder 80 with a bore 82 therethrough which extends along the elevation axis 22. The air foils 12 and 14 each have a pair of extensions 84 which fit around the ends of the cylinder 80 and have bores 86 formed therein. A shaft 88 passes through bores 82 and 86 to pivotally secure the air foils 12 and 14 to the rotation axles 34 for pivotal motion about the elevation axis 22. As can best be seen in FIG. 7, each of the extensions 84 have a series of elevation gear teeth 90 thereon.

Figure 10:
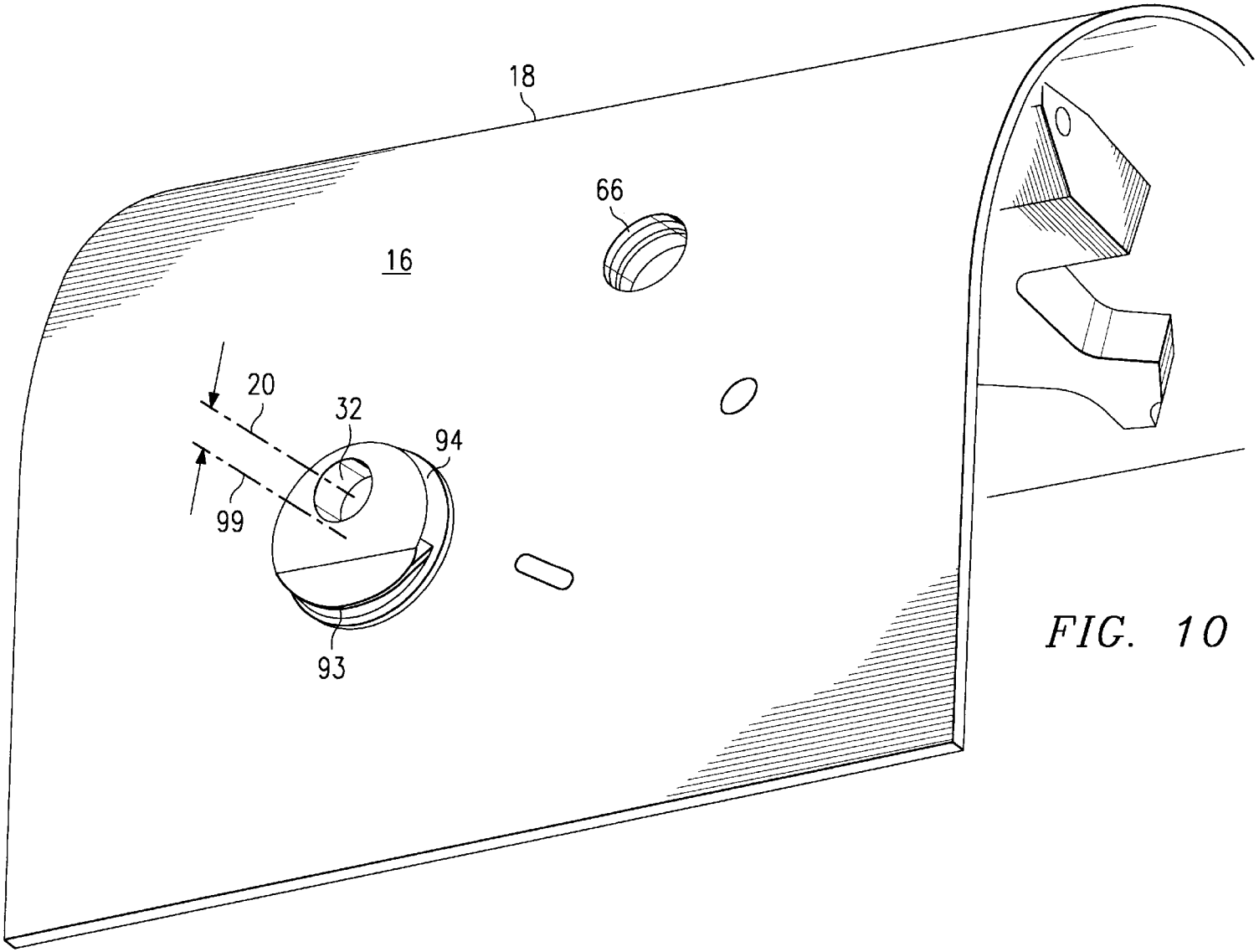
FIG. 10 is a perspective view of the bridge structure illustrating the eccentric boss.
Figure 11:
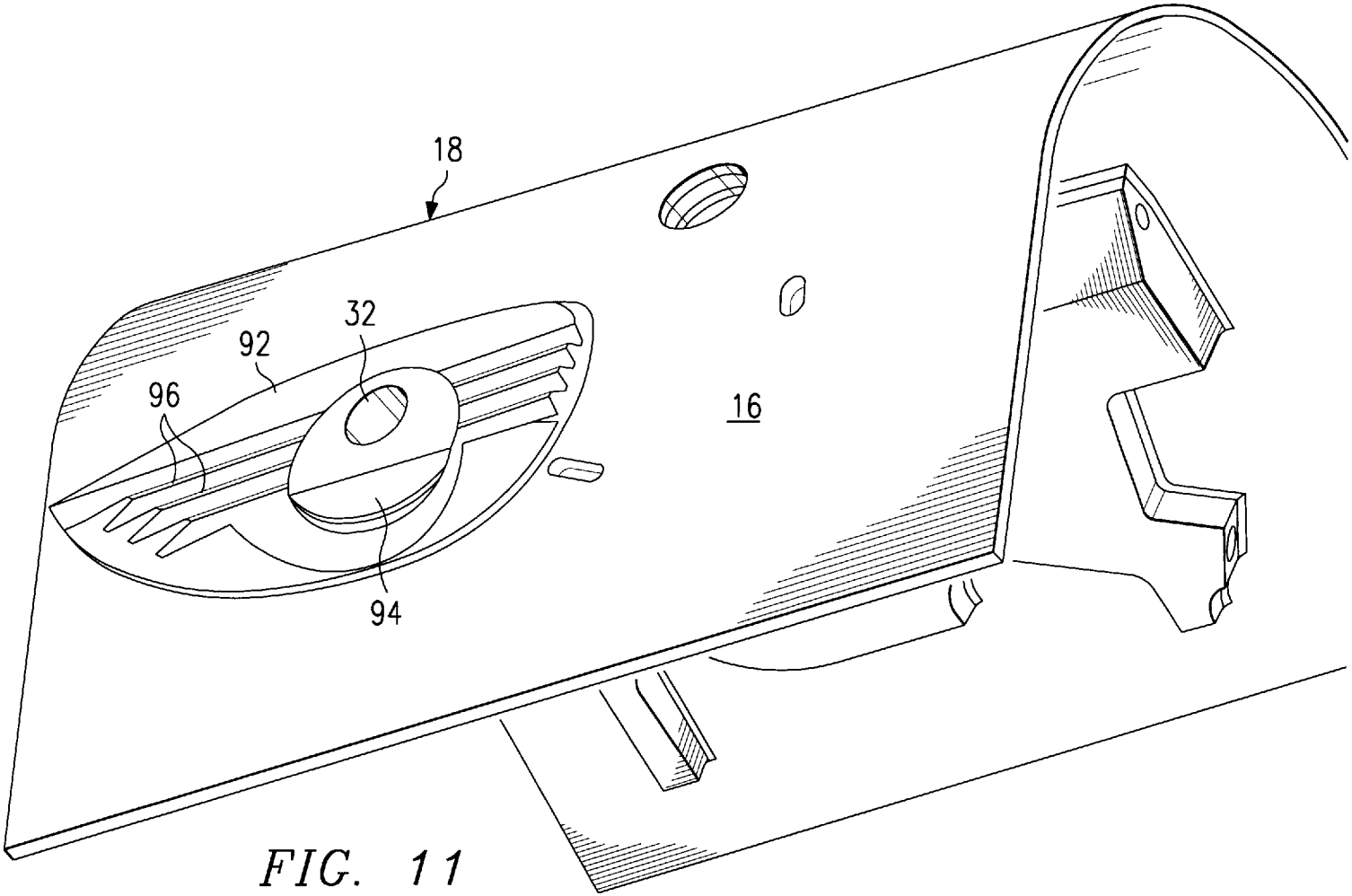
FIG. 11 is a perspective view of the bridge structure illustrating the sliding gear rack mounted on the eccentric boss.
Figure 12:
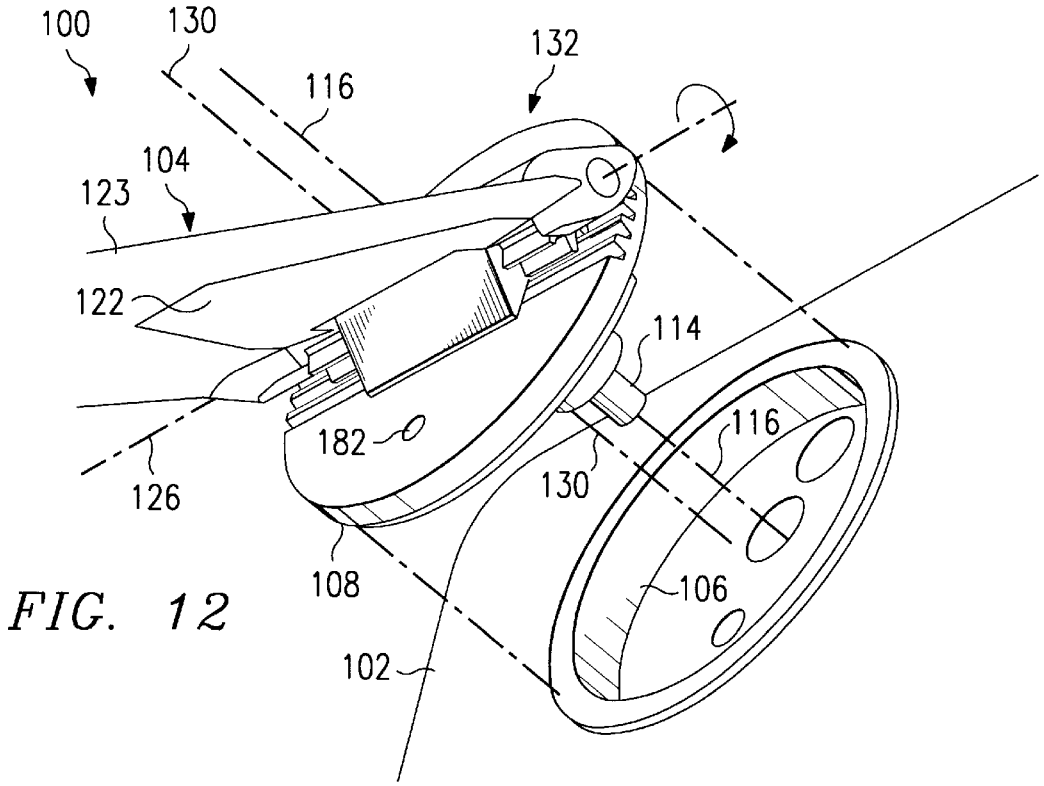
FIG. 12 is an exploded perspective view of the mechanism forming a second embodiment of the present invention.
Figure 13:
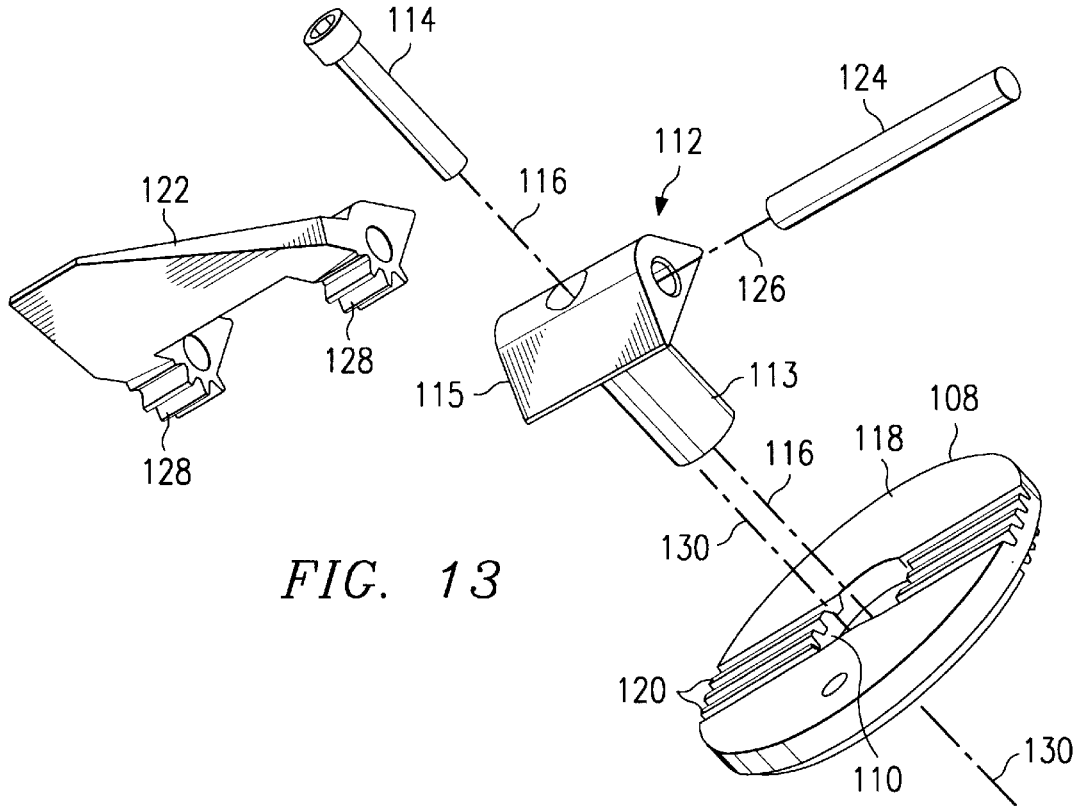
FIG. 13 is an exploded view of a portion of the mechanism of FIG. 12.

As best seen in FIGS. 1, 10 and 11, a sliding gear rack 92 is mounted on the exterior surface 16 about each aperture 32. The sliding gear rack 92 engages an eccentric boss 94 formed on the exterior surface 16 about each of the apertures 32, as seen in FIG. 11. The exposed surface of the sliding gear rack 92 is formed of elevation gear teeth 96 which mesh with teeth 90 on the air foil. The sliding gear rack 92 is capable of pivotal motion relative the rotation axis 20 but, because of the eccentricity of the boss 94, the center axis of the sliding gear rack 92 is offset from the rotational axis 20. As best seen in FIG. 10, the eccentricity of boss 94 can be achieved by using a cylindrical boss 94 with its axis 99 offset from axis 20 as shown.

As can be understood, once the munition on which mechanism 10 is mounted begins flight, air pressure will build up against the air foils. The airfoils will try to deploy, pressurizing the hydraulic fluid in the chamber 26 of the first portion 56 through the rotation axles 34 and rack shafts 30 until the first diaphragm therein, described below, bursts, permitting the air flow to drive the air foils into the deployed position. The motion of the air foils will be synchronized together through the action of the hydraulic fluid between the foils and deployed at a controlled speed by the controlled rate of flow from the hydraulic damper.

In place of air flow activation of the air foils, a pressurized fluid or gas could be provided in passage 28 of portion 58 to drive the air foils to the deployed position. For example, an air or other gas pressure cylinder, at perhaps 3,000 psi, can be used to pressurize the hydraulic fluid and deploy the air foils. Also, a pyrotectic squib can be used to pressurize the hydraulic fluid. These methods would deploy the air foils, if desired, against the air flow pressure of the munition in flight.

Rather than having the air flow acting on the air foils directly deploy the air foils, another mechanism, such as a lanyard connected to a drag chute, can be acted on by the air flow to deploy the air foils.

The rotation gears 36 are splined to the rotation axles 34 for joint rotation. As the pivotal motion is initiated about rotation axes 20, the sliding gear racks 92 also pivot through engagement with the air foils and begin to rotate on surface 16 around eccentric boss 94. The rotation is about axis 99. A clearance cut 93 may be necessary in boss 94 to pass teeth 90 of the air foil as the air foil and axle 34 pivot about axis 20. The structure is designed so that when the rotation gears 36 are stopped by bump stops 46, the air foils have been fully deployed both by movement about the rotation axis 20 and about the elevation axis 22. The deployed position can be adjusted slightly by threading bump stops 46 into or out of the threaded bosses 44. In the deployed position, the rotation locks 50 are urged into lock notches 70 on the rotation gears 36 to hold the air foils in the deployed position.

Figure 8:
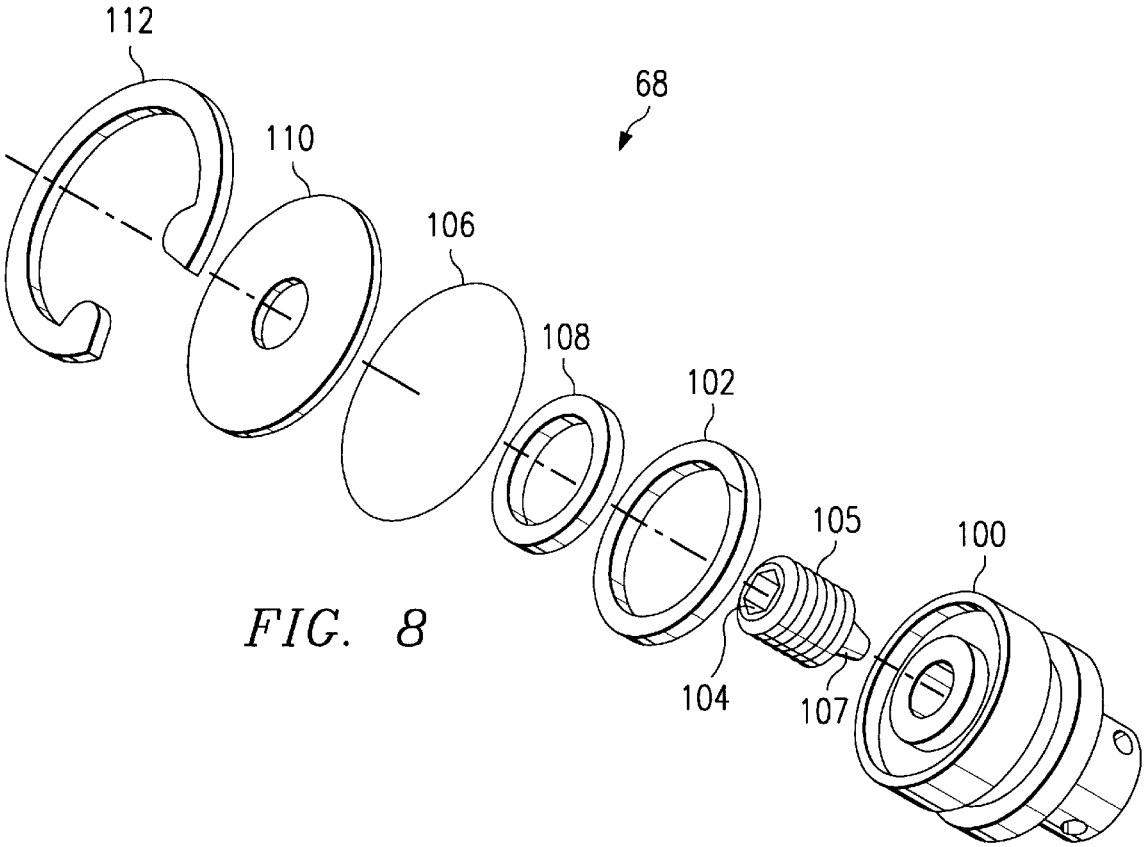
FIG. 8 is an exploded view of the hydraulic orifice assembly.

With reference to FIG. 8, the hydraulic damper 68 controls the deploying rate of the mechanism 10. An orifice housing 100 is fit within the pocket 66 and sealed thereto by an O-ring 102. The housing defines a small orifice to bleed hydraulic fluid from passage 26 in portion 56 to exterior the mechanism 10. An orifice rate adjustment screw 105 is screwed into housing 100. The orifice rate adjustment screw 105 has a tapered end 107 which extends into the orifice in the housing 100. The screw 105 can be threaded in or out of the housing to vary the area of the annulus formed between the tapered end 107 and the walls of the orifice in the housing. A burst diaphragm 106 is sealed over the orifice with an O-ring 108. A washer 110 provides the sealing pressure against the burst diaphragm 106 when snap ring 112 engages a retaining groove in the pocket 66, trapping the damper and compressing the 0-ring 108 for sealing. When the air foils begin deployment, the hydraulic pressure rapidly increases in the passage 26, bursting the diaphragm 106 and allowing the hydraulic fluid to escape at a controlled rate through the orifice, thus providing deployment of the air foils at a controlled rate. The rate of hydraulic fluid discharge, and therefore the rate of deployment of the air foils, can be adjusted by threading the screw 105 further into the orifice housing 100 to decrease the area of the annulus between the orifice in the housing and the tapered end 107, thereby slowing the flow rate of fluid through the annulus and the rate of deployment, or backing the screw 105 slightly out of the housing 100 to enlarge the annulus between the orifice in the housing 100 and the tapered end 107 to increase the discharge rate of the hydraulic fluid, lessening the time of deployment of the air foils. In one embodiment, a deployment rate of about 0.5 seconds is desired.

The hydraulic damper is mounted through the exterior surface 16 of the bridge structure 18. This provides easy replacement of the burst diaphragm should the system be accidentally discharged.

Instead of a hydraulic damper, a shock absorber system could be used as a substitute. The shock absorber system would delay the deployment of the air foils at a rate determined by the shock absorber.

As can be understood, the mechanism 10 provides for the facilitation of maximum load out of submunitions in delivery vehicles such as TACMs or MLRs. A minimum intrusive volume, two axis fold mechanism as disclosed allows aerodynamic surfaces or other devices, which normally extend perpendicular to the body length, to be folded along the submunition body length. The general principles of the mechanism disclosed herein could be tailored to suit many other different applications as well.

By mounting the air foils 12 and 14 on the bridge structure 18, the entire mechanism mounts as a modular unit. This allows assembly and adjustment of the wing anhedral and incidence angle to be performed prior to attachment to the main structure, as well as providing additional access to the interior of the vehicle for other assembly tasks. If the air foils are folded forward along the fuselage of a vehicle, aerodynamic forces can provide the energy to open the air foils. As such, the passage 28 on portion 58 need not be provided with a high pressure gas or fluid to activate the air foils. However, the mechanism is equally adaptable to the air foils being folded rearward along the fuselage by providing a suitable energy source to apply to the air foils to deploy the air foils against aerodynamic loads as discussed previously. The mechanism will function for a large range of rotation and elevation fold angles, allowing tailoring of the mechanism to many different applications.

The bridge structure 18 can be a one-piece casting, including the bosses 94, the bosses necessary to form the hydraulic passages 26, 28, 54 and 60, the bosses for containing the rotation locks 50, the bump stops 46 and for general structural stiffening. Jig boring of the part is not required. A simple drill fixture will allow all hydraulic passages and axle or slide bores to be machined. The bridge structure is designed to fit both the glider and powered submunition LOCAAS vehicles with no modifications and provides a portion of the upper fuselage skin.

The coupling through passages 54 as shown can be reversed side for side, or even used as a dual link system, if desired.

The ends of each of the passages can be closed off with short press-in plugs or removable plugs, if desired. For an aft deploying system (i.e., wings folded forward), the gear racks would move forward. For a forward deploying system (i.e., wings folded aft), the gear racks would move aft. One option for an energy supply to open the air foils against aerodynamic loads on an aft folded system would be, as previously noted, to allow a gas generator squib to pressurize the forward end of a rack shaft, transferring the opening energy through the hydraulic link to open the other rack.

If desired, the snap ring 38 securing the rotation gear 36 to the rotation axle 34 can be replaced by bolting the gear to the rotation axle.

The physical distance between the sliding gear rack 92, axis 99 and the rotation axis 20 is determined by the desired ratio of air foil rotation to air foil elevation angles, and by the pitch diameter of the air foil gear teeth. For one particular example for LOCAAS, rotation angle equals 90°, elevation angle equals 49°, and air foil gear pitch diameter is 0.625 inch, the sliding gear rack versus rotation axis separation must be 0.267 inch. The separation, or eccentricity, can be derived from the following formula:

$$\text{Eccentricity}=(\text{elevation angle})\ (\text{air foil gear pitch diameter})/[(360)+(\sin(\text{rotation angle}))]$$

This formula assumes that the eccentric separation of the rotation axis 20 and sliding gear rack axis 99 is parallel to the wing elevation axis center line 22 with the mechanism in the folded position, and that the axis 22 is rotated 90° about axis 20.

The fold axis movement approaches the elevated position by following a portion of a sine curve, i.e., $$\text{Elevation angle}=(\text{total fold angle})\ (\sin[\text{rotation angle}])$$

This particular arrangement illustrated allows the wing elevation motion to come up to a very soft stop, thus requiring damping in the rotation axis direction only.

Figure 19:
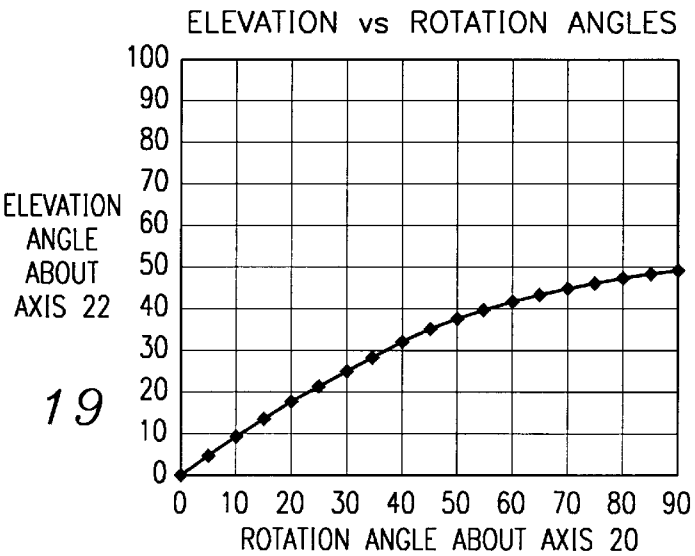
FIG. 19 is a graph illustrating the rate of rotation axis movement to elevation axis movement.

In FIG. 19, the above example application is illustrated where the rate of rotation axis movement to elevation axis movement is shown. Zero degrees rotation angle and zero degrees elevation angle start in the folded position.

Placing the eccentric separation of the rotation and sliding gear rack axes on some orientation other than the closed air foil elevation axis position moves the elevation motion to a different portion of a sine curve. This phenomena can be used to tailor elevation motion to allow additional energy for engaging locking mechanisms or other devices requiring higher closing shocks. However, the alignment of the eccentricity as shown in LOCAAS example above has the advantage that positive and negative lift loads on the wing cannot create torques around the rotation axis. This significantly reduces the forces trying to disengage the rotation axis locking device.

While the present invention has been illustrated for deploying two air foils, any number of air foils can be deployed by connecting the air foils through a hydraulic fluid connection as described previously. For example, four air foils can be deployed simultaneously, if desired, with hydraulic circuits 26, 54, 28 connected in series to four air foils to deploy the air foils in a controlled synchronized manner.

With reference now to FIGS. 12–18, a second embodiment of the present invention will be described which is formed by a mechanism 100. The mechanism includes a pair of wing deployment apparatus 132, each having an air foil or wing 104. The mechanism 100 is mounted on bridge structure 102 which can be a portion of the frame or body of a rocket or missile also. The mechanism 100 deploys wings 104 simultaneously from a folded configuration to the deployed configuration at a controlled rate.

On each side of the center line of the bridge structure 102 is formed a circular pocket 106. An elevation plate 108 is received in the pocket such that it is confined by the walls of the pocket but can pivot about axis 130 shown in FIGS. 14A and 14B in the pocket. The elevation plate 108 has a shaped aperture 110 which receives a portion 113 of a T-joint fitting 112. A securing bolt 114 is inserted into the top of the T-portion 115 of the T-joint fitting with the head of the bolt resting against a flange within the fitting. The securing bolt is then threaded into the bridge structure 102 to secure the T-joint fitting and elevation plate 108 within the pocket 106. The T-joint fitting 112 is permitted to pivot about a rotation axis 116 coinciding with the center line of the securing bolt 114 while the elevation plate pivots about axis 130 at the center of pocket 106.

The front surface 118 of the elevation plate 108 is formed with a series of gear teeth 120. A wing root 122 is mounted to the T-joint fitting 112 at T-portion 115 by an axle pin 124 which permits the wing root 122 to pivot about an elevation axis 126 relative the T-joint fitting 112. The wing root is formed with a series of gear teeth 128 which mesh with the gear teeth 120 on the elevation plate 108. The wing 123 itself is bolted or otherwise secured to the wing root to form the complete wing assembly or air foil 104. As can be understood with reference to FIGS. 14A, 14B and 15, as air flow strikes the wing 123 and wing root 122, the air flow exerts a force tending to rotate the wing, wing root and T-joint fitting 112 about the rotation axis 116 of the T-joint fitting 112. Because of the engagement between the gear teeth 128 of wing root 122 and the gear teeth 120 of elevation plate 108, the elevation plate 108 is also pivoted at the same time. However, the elevation plate 108 rotates about the center axis 130 which is spaced from the rotation axis 116. Thus, the elevation plate 108 and T-joint fitting 112 effectively slide relative each other so that the gear teeth 120 on the elevation plate 108 engaging the gear teeth 128 on the wing root 122 cause the wing root to move between the folded position F and the elevated position E. The shaped aperture 110 must be sufficiently large to allow the movement required between the elevation plate 108 and the T-joint fitting 112. It is illustrated as a kidney-shaped configuration in FIGS. 14A and 14B, making the mechanism bi-directional, allowing the wing to be elevated in either direction from the folded position. However, if only a single direction is necessary, the aperture 110 can be suitably modified. Further, the aperture 110 can clearly be simply a large enough circle to accommodate the necessary range of motion, if desired.

FIG. 15 illustrates a graph of the deployment of the wing from the folded position F to the deployed or elevated position E. The deployment follows a portion of a sine curve S which can be defined by the angular and radial offset of the T-joint axis of rotation 116 and the elevation plate axis of rotation 130, the total amount of rotation and the pitch diameter of the gear teeth on the wing root and T-joint fitting. By positioning the deployed position toward the top of the sine curve where the rate of elevation to rotation decreases, the momentum of the mechanism is decreased at the deployed position to provide a softer entry into the deployed position.

Figure 16:
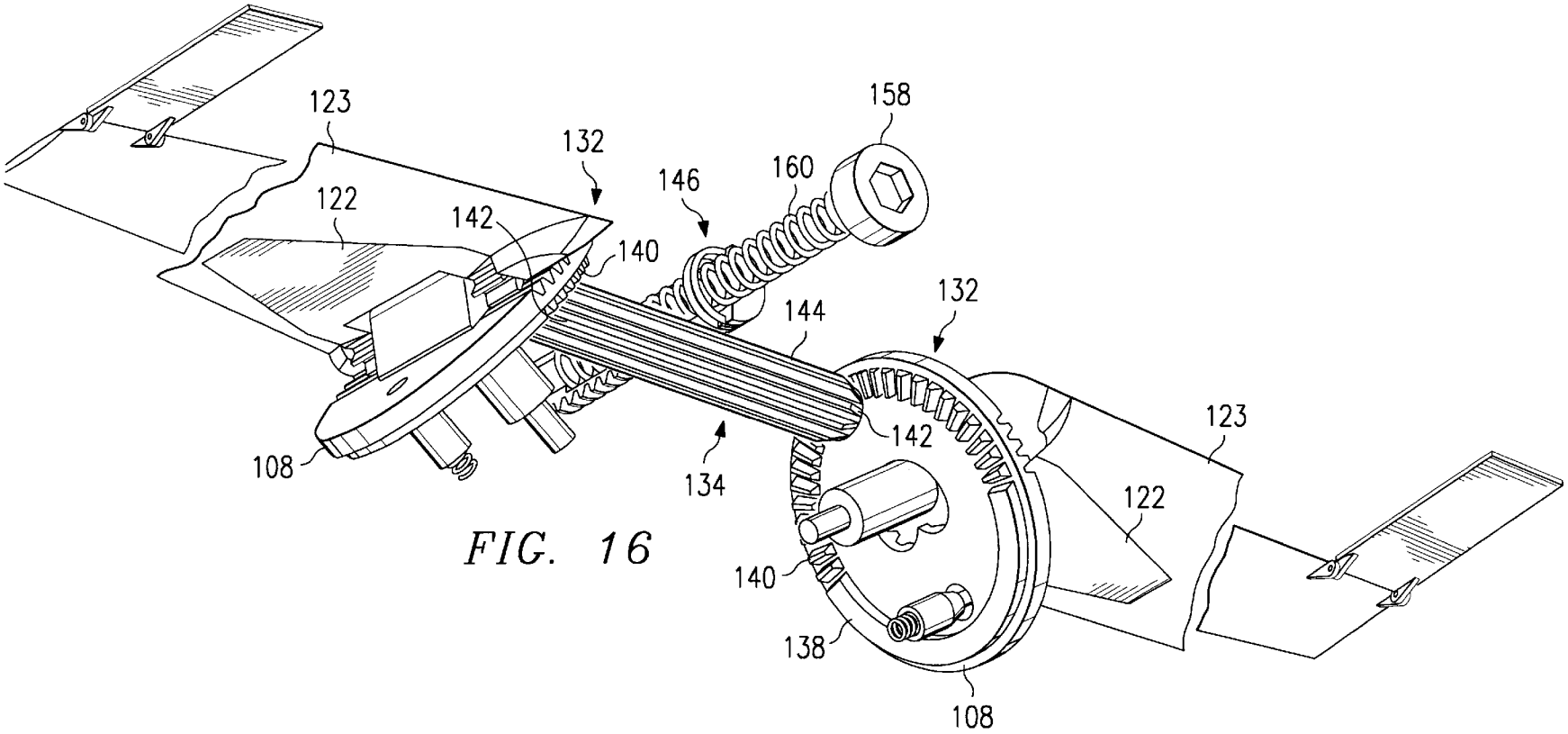
FIG. 16 is a perspective view of the mechanism illustrating the cross shaft and hydraulic damper.
Figure 17:
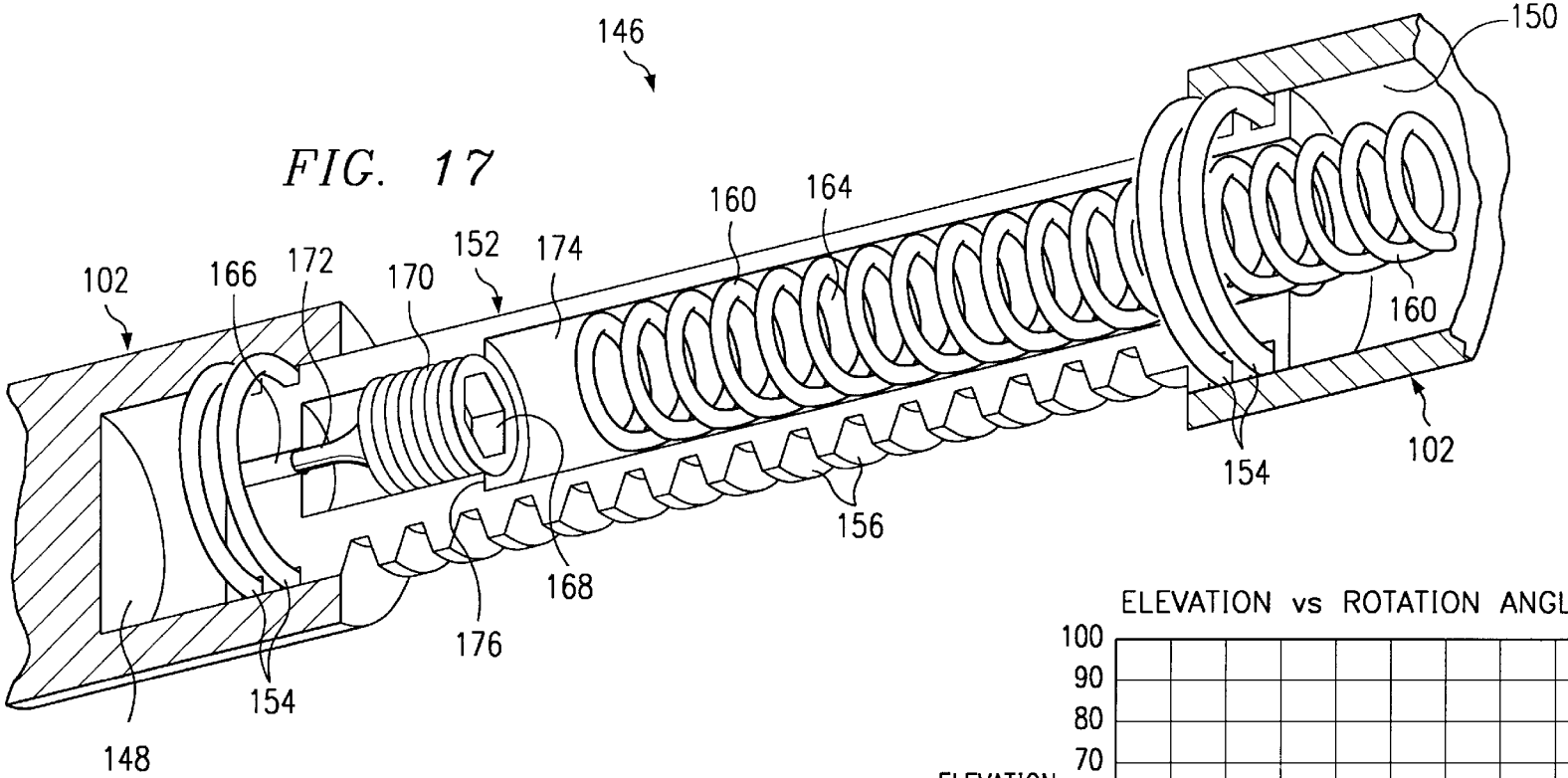
FIG. 17 is a perspective detail view of the hydraulic damper.

As seen in FIG. 16, a pair of wing deployment apparatus 132 can be mounted on the bridge structure 102 and operated simultaneously through the use of a cross shaft 134. The cross shaft 134 is mounted within the bridge structure 102 for rotational motion about its elongate axis. The back side 138 of each elevation plate 108 is provided with beveled gear teeth 140. The ends of the cross shaft 134 are similarly formed with beveled gear teeth 142, which mate with teeth 140. Thus, pivotal motion of one elevation plate 108 will be replicated in the other elevation plate 108, and vice versa, through the cross shaft 134.

The cross shaft 134 can also be provided with spur teeth 144 to engage a hydraulic damper 146 to control the speed of deployment of the wings. A portion of the hydraulic damper 146 is formed by the bridge structure 102 itself defining a first fluid chamber 148 and a second fluid chamber 150 separated by an open passage facing the cross shaft 134. A damper piston 152 is sealed at its ends within the first and second fluid chambers 148 and 150 by pairs of sealing rings 154. The middle portion of the damper piston 152 is provided with rack gear teeth 156 which mesh with the spur gear teeth on the cross shaft 134. At the end of the second fluid chamber 150 opposite the damper piston 152 is a plug 158 which seals the fluid chamber but allows fluid to be added when necessary. The first fluid chamber 148 preferably is a blind boring, although a plug can be mounted in the end thereof, if desired.

A spring 160 is positioned within the second fluid chamber 150 between the plug 158 and the damper piston 152 to either assist or retard wing deployment, depending on the particular direction of wing deployment rotation selected.

A passage 164 is formed through the damper piston 152 to connect the first and second fluid chambers 148 and 150. The passage 164 is formed with different diameters. A bleed passage 166 provides a small diameter aperture to permit control of the flow rate of fluid from one fluid chamber to the other. A larger diameter intermediate passage 168 has a threaded wall to receive a threaded flow rate adjuster 170. The flow rate adjuster has a pin 172 at the end thereof which is extended into the bleed passage 166. Either the bleed passage 166, or pin 172, or both, are tapered so that screwing the flow rate adjuster 170 so that pin 172 moves either further into the bleed passage 166 or retracts out of the bleed passage varies the effective orifice size for flow of fluid between the fluid chambers 148 and 150, thus providing a control for the speed of deployment of the wings. A spring passage 174 is of larger diameter, containing a portion of the spring 160 and defining an annular spring surface 176 against which the end of the spring within the piston rests. The surface 176 is formed in the transition between spring passage 174 and intermediate passage 168.

Figure 18:
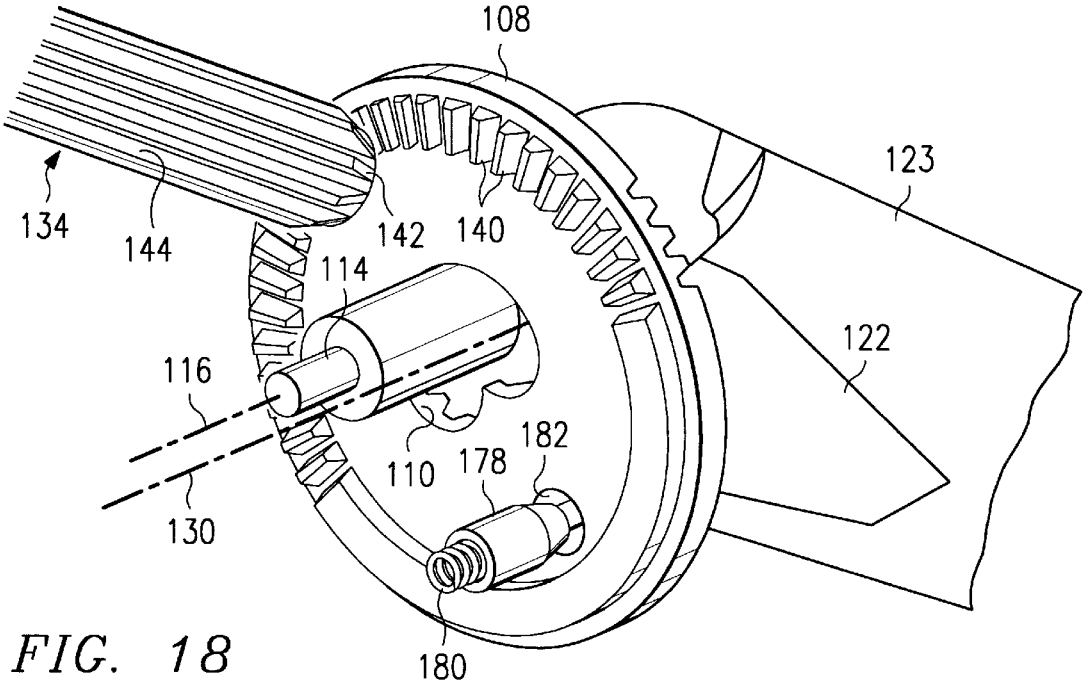
FIG. 18 is a perspective view of the mechanism illustrating the locking pin.
Figure 9:
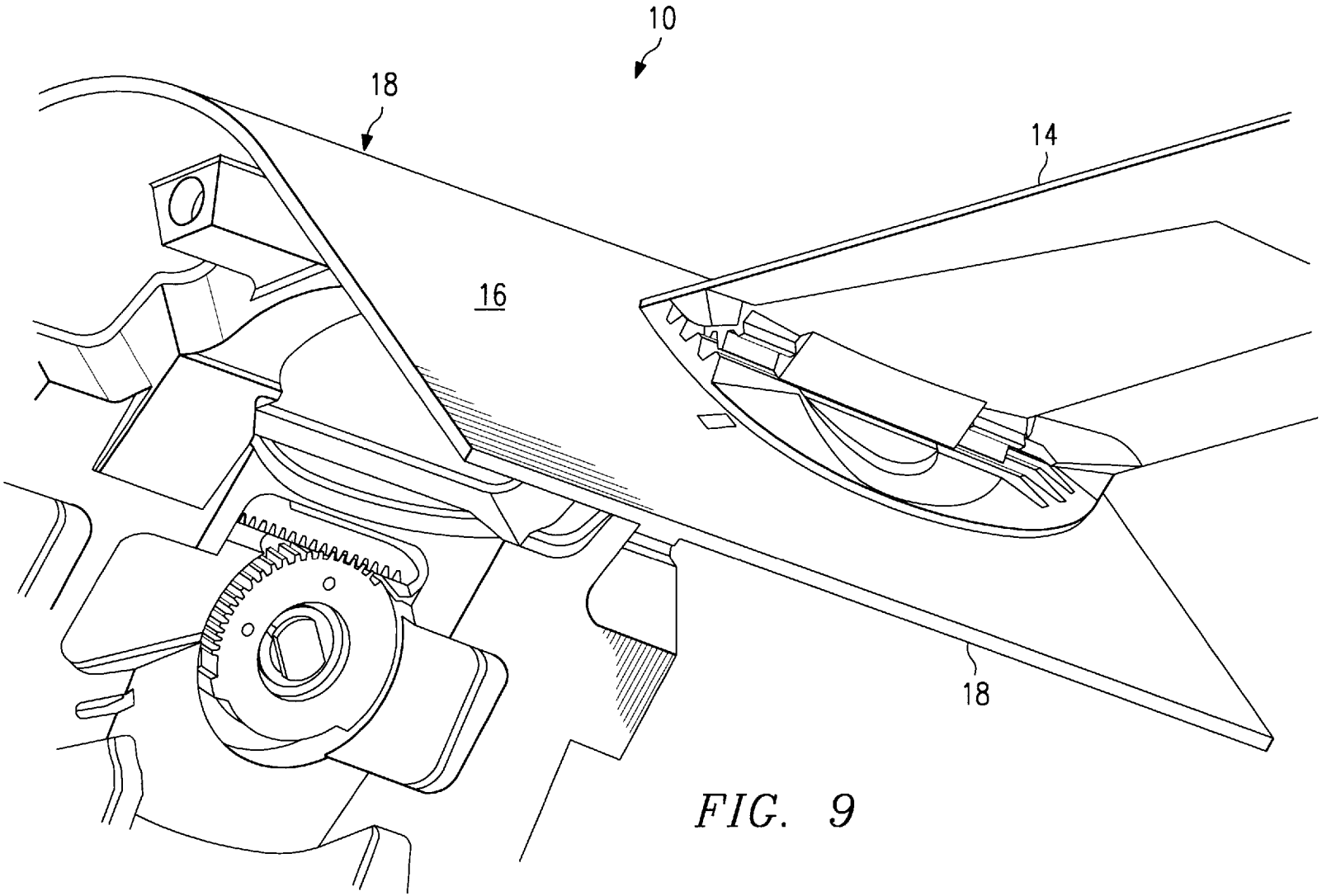
FIG. 9 is a perspective view of the mechanism showing the air foil deployed.

With reference to FIG. 18, the pocket 106 within the bridge structure 102 can mount a locking pin 178. The locking pin is urged outwardly by a spring 180. As the elevation plate 108 pivots to a position with the wing deployed, the locking pin 178 will be forced into a locking pin hole 182 in the elevation plate 108 to lock the elevation plate 108 and wing in the deployed position. If desired, the pin 178 can be pushed out of hole 182 by a suitable tool from the outside surface of the elevation plate 108 to allow the wing to be moved back to the folded position. When dual wing deployment apparatus 132 are used, locking pins 178 can be used in each wing deployment apparatus, if desired. Alternatively, a single locking pin in one apparatus can be effective to lock both apparatus in the deployed position. Clearly, if a locking pin is used for each apparatus, both locking pins must be retracted simultaneously to permit the apparatus to be returned to the folded position.

Because of the critical force transfer between the gear teeth of the wing root 122 and the T-joint fitting 112, it is preferred to make the wing in two parts, the wing root 122 and the aerodynamic wing attachment 123 which is bolted or otherwise secured to the wing root 122. For example, the wing root 122 can be made of 260 ksi strength steel while the wing 123 attached thereto is cast aluminum. For example, in one design constructed in accordance with the teachings of the invention, the wing root 122 had dimensions of roughly three by three inches while the wing 123 attached thereto was twelve inches long and four inches wide. The wing 123 would fit over the wing root 122, including the ends of the axle pin 124 to hold the axle pin 124 in place. Alternatively, the axle pin 124 can be swaged, threaded or otherwise secured within the wing root 122 to prevent its inadvertent movement.

Although the present invention has been described with respect to specific preferred embodiments thereof, various changes and modifications may be suggested to one skilled in the art. It is intended that the present invention encompass such changes and modifications as fall within the scope of the appended claims.

I claim:

1. A mechanism for deploying an air foil, comprising:

a frame;

an elevation plate mounted to the frame for pivotal motion about a first axis;

a T-joint mounted to the frame for pivotal motion about a second axis;

a wing assembly mounted to the T-joint for pivotal motion about a third axis between a folded position and an elevated position, pivotal motion of the T-joint about the second axis causing pivotal motion of the elevation plate about the first axis and pivotal motion of the wing assembly about the third axis.

2. The mechanism of claim 1, wherein the wing assembly includes a wing root and a wing mounted on the wing root.

3. The mechanism of claim 1, wherein the first and second axes are parallel and the third axis is perpendicular to the first and second axis.

4. The mechanism of claim 1, wherein the elevation plate has gear teeth formed thereon and the wing assembly has gear teeth formed thereon, the gear teeth of the elevation plate and wing assembly in meshing engagement.

5. The mechanism of claim 1, wherein the elevation plate, T-joint and wing assembly define a first wing deployment apparatus, a second wing deployment apparatus being mounted on the frame, each of the elevation plates in the first and second wing deployment apparatus having a series of beveled gear teeth about the periphery thereof, the mechanism further comprising a cross shaft mounted on the frame and having beveled teeth engaging the beveled teeth on the elevation plates to ensure joint motion of the elevation plates of the first and second wing deployment apparatus.

6. The mechanism of claim 5, further comprising a damper in operable engagement with the cross shaft to control the speed of movement of the elevation plates of the first and second wing deployment apparatus.

7. The mechanism of claim 1, further comprising a lock pin mounted in the frame, the lock pin engaging the elevation plate when the wing assembly is pivoted to the elevated position to secure the wing assembly in the elevated position.

8. The mechanism of claim 1, wherein the wing assembly is oriented on the frame so that air flow past the frame pivots the T-joint and the wing assembly to the elevated position.

9. The mechanism of claim 6, wherein the damper is a hydraulic damper.

10. The mechanism of claim 9, wherein the hydraulic damper is adjustable to provide variable speed deployment.

* * * * *